US006558487B1

(12) United States Patent
Tadros

(10) Patent No.: US 6,558,487 B1
(45) Date of Patent: May 6, 2003

(54) SMOKE GENERATING COMPOSITIONS AND METHODS OF MAKING THE SAME

(75) Inventor: Raef M. Tadros, White Hall, AR (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/912,021

(22) Filed: Jul. 24, 2001

(51) Int. Cl.[7] ..... C06B 49/10; C06B 29/10

(52) U.S. Cl. ..... 149/19.1; 149/19.7; 149/83; 149/84; 149/117; 516/2

(58) Field of Search ..... 516/2; 102/334; 149/19.1, 19.7, 117, 83, 84

(56) References Cited

U.S. PATENT DOCUMENTS 3,717,097 A * 2/1973 Wronka et al. ..... 102/334
3,785,149 A * 1/1974 Timmerman ..... 102/531
H227 H * 3/1987 Tracy et al. ..... 149/84
H233 H * 3/1987 Tracy ..... 149/117
4,898,098 A * 2/1990 Frey et al. ..... 102/334
5,154,782 A * 10/1992 Shaw et al. ..... 516/2
5,522,320 A * 6/1996 Dillehay ..... 102/334
6,302,979 B1 * 10/2001 Matsuoka et al. ..... 149/114

* cited by examiner

*Primary Examiner*—Daniel S. Metzmaier
(74) *Attorney, Agent, or Firm*—Ulysses John Biffoni

(57) ABSTRACT

A smoke generating composition including at least one smoke generating material and an effective amount of a polymerized monosaccharide or disaccharide as a binder. The polymerized monosaccharide or disaccharide serves the dual purpose of being both a binder and a fuel to provide a more efficient and safer smoke generating composition.

29 Claims, No Drawings

SMOKE GENERATING COMPOSITIONS AND METHODS OF MAKING THE SAME

GOVERNMENT INTEREST

The invention described herein may be manufactured, used and licensed by or for the United States Government.

FIELD OF THE INVENTION

The present invention is generally directed to smoke generating compositions and methods of making the same in which a polysaccharide such as polymerized sucrose is used as a binder.

BACKGROUND OF THE INVENTION

Smoke generating compositions which can be used by the military to produce white or colored smoke typically contain a formulation for generating smoke often including a monosaccharide or disaccharide (e.g. sucrose) as a fuel, and a binder for maintaining the smoke generating formulation, typically in the form of a mixture of smoke generating materials in a compact form so that it may be used in the production of, for example, smoke generating grenades.

The binder typically used in smoke generating compositions of this type is polyvinyl alcohol. The polyvinyl alcohol is dissolved to provide a liquid capable of being sprayed onto the components of the smoke generating formulation which are in the form of dry mix granules. The spraying typically takes place in a fluidized bed. The binder assists in forming particles of the smoke generating formulation or mixes and allows the mixes to consolidate to thereby form pellets. The pellets can then be incorporated into smoke generating devices such as grenades.

Polyvinyl alcohol is problematical as a binder for forming smoke generating compositions because it tends to cross-link adjacent polymer chains or branches of the same polymer chain. Cross-linking of polyvinyl alcohol in this manner often results in a cross-linked material which sticks to the equipment used to make and transfer the polyvinyl alcohol solution.

The formation of layers of the polyvinyl alcohol material on various equipment including double jacket steam reactors can adversely affect heat transfer. In addition, the presence of the cross-linked material in the flow system and spray system can create pressure head and actually block the nozzles of the spray system. Prepared solutions of polyvinyl alcohol dissolved in a solvent require continuous heating and agitation to avoid solidification of the polyvinyl alcohol material. Once solidified polyvinyl alcohol will not re-dissolve in the original solvent or in any other organic solvent and thus loses its function as a binder. Thus, when polyvinyl alcohol is used as a binder maintenance requirements are high.

Polyvinyl alcohol also adversely effects the efficiency of the smoke generating composition to generate smoke. Polyvinyl alcohol creates about 30% of compact ash when the smoke generating material is ignited. The compact ash prevents some of the smoke generating materials from functioning properly and thereby reduces the output of the smoke generating device.

Other problems associated with the use of polyvinyl alcohol as a binder is its high cost, the possibility that it may be carcinogenic and the possibility that it is responsible, at least in part, for wide variation in burn times for smoke generating grenades operating in hot and cold environments. The wide variation in burn times affects smoke quality and thus leads to wide variations in smoke quality over a range of operating temperatures.

It would therefore be a significant advance in the art of producing smoke generating compositions including those that may be used in military devices such as smoke grenades to eliminate polyvinyl alcohol as a binder. It would be a further advance in the art to employ a binder for a smoke generating composition which eliminates or at least reduces the problems associated with polyvinyl alcohol.

SUMMARY OF THE INVENTION

The present invention is generally directed to a smoke generating composition in which polyvinyl alcohol is no longer used as a binder but is replaced by a polymerized monosaccharide or disaccharide.

In a particular aspect of the present invention, there is provided a smoke generating composition comprising:

a) at least one smoke generating material; and b) a binder comprising a polymerized monosaccharide or disaccharide.

In a further aspect of the present invention, a portion of the monosaccharide or disaccharide is polymerized to form the binder which reduces the cost of the smoke generating device and eliminates the use of a binder which heretofore has caused significant problems with the production of smoke generating compositions.

In a further aspect of the present invention, there is provided a method of producing a smoke generating composition comprising treating at least one smoke generating material with an effective amount of a binder in the form of a polymerized monosaccharide or disaccharide.

DETAILED DESCRIPTION OF THE INVENTION

The present invention is generally directed to a smoke generating composition and method of preparing the same in which a polymerized monosaccharide or disaccharide is employed as a binder.

Although any monosaccharide or disaccharide may be employed in the present invention, a clearly preferred embodiment is the use of polymerized sucrose because sucrose is typically used as one of the smoke generating materials (i.e. as a fuel). A part of the sucrose is first polymerized and then dissolved in water and sprayed over the smoke generating materials.

The polymerized monosaccharide or disaccharide binder is particularly effective for smoke generating compositions because it is water soluble and easily sprayed over the smoke generating materials. As the monosaccharide or disaccharide is polymerized, it does not lose its original function as a fuel within the smoke generating composition. Thus, the polymerized monosaccharide or disaccharide serves a dual purpose of being both a binder and a fuel to provide a more efficient smoke generating composition.

The binder of the present invention is prepared by polymerizing a monosaccharide or disaccharide (e.g. sucrose) in the presence of an acid catalyst, preferably under vacuum at a temperature typically in a range of from about 60 to 120° C., most preferably about 80° C. There are a variety of catalysts that may be used for this purpose, including but not limited to, p-toluene sulfonic acid and sulfuric acid. The reaction typically takes place at a mass ratio of monosaccharide or disaccharide:acid catalyst:water of from about 1:0.001:0.04 to 1:0.01:0.15, most preferably a mass ratio of about 1:0.005:0.1.

The polymerization process is preferably conducted under agitation and reduced pressure of from about 200 to 700 mmHg, most preferably about 400 mmHg. The polymerization process typically takes from about 1 to 6 hours, depending in part on the mass ratio, temperature and pressure employed in the polymerization process.

Smoke generating materials are generally known in the art and include, for example, magnesium carbonate, potassium chlorate and monosaccharides and disaccharides (e.g.sucrose) as a fuel. The amount of monosaccharide or disaccharide is typically from about 13 to 18% by weight of the smoke generating composition. In the preparation of white smoke generating compositions, terephthalic acid alone or in combination with pentaerythritol is used in combination with magnesium carbonate and potassium chlorate. Stearic acid may be used as an optional component. In the preparation of colored smoke generating compositions, potassium chlorate, magnesium carbonate and sucrose are typically combined with a dye such as solvent yellow 33 (for the production of yellow smoke) and solvent yellow 33 combined with solvent green 3 (for the production of green smoke).

The preparation of white smoke generating compositions in accordance with the present invention is prepared by combining a first composition containing 70 to 100% by weight of terephthalic acid alone or in combination with 0 to 30% by weight of pentaerythritol. The first composition prepared above is combined with magnesium carbonate, potassium chlorate, optionally stearic acid, and sucrose to form a white smoke generating composition. From about 12% to 100%, preferably from about 15% to 50% of the monosaccharide or disaccharide (e.g. sucrose) employed in the smoke generating composition will be polymerized in accordance with the present invention to provide a binder which is formed into a solution and then sprayed on the other components of the smoke generating composition.

The amounts of the components of a typical white smoke generating composition in accordance with the present invention are shown in Table 1.

TABLE 1

White Smoke Generating Compositions

| | Weight Percentage |
|---|---|
| Sub-mixture Component | |
| Terephthalic Acid | 70–100 |
| Pentaerythritol | 30–0 |
| Component | |
| Sub-mixture Composition | 55 +/− 2 |
| Magnesium Carbonate | 4.5 +/− 1.5 |
| Stearic Acid | 2.0 +/− 1.0 |
| Potassium Chlorate | 23 |
| Sucrose | 14* |

*From about 12 to 100% of the sucrose is polymerized to from a binder

The components of colored smoke generating compositions in accordance with the present invention, such as a yellow smoke generating composition and a green smoke generating composition, respectively are shown in Tables 2 and 3. In each case, from about 12 to 100% of the sucrose is polymerized, formed into a solution and then sprayed over the remaining components to bind the components together into a smoke generating composition suitable for use for a smoke generating device such as a grenade.

TABLE 2

Yellow Smoke Generating Composition

| Component | Weight Percentage |
|---|---|
| Dye, Solvent Yellow 33 | 41.7 +/− 1.5 |
| Potassium Chlorate | 22.5 +/− 2.0 |
| Magnesium Carbonate | 20.5 +/− 3.0 |
| Sucrose | 15.3 +/− 1.5* |

*From about 12 to 100% of the sucrose is polymerized to form a binder.

TABLE 3

Green Smoke Generating Composition

| Component | Weight Percentage |
|---|---|
| Dye, Solvent Yellow 33 | 12.5 +/− 0.5 |
| Dye, Solvent Green 3 | 29.5 +/− 1.0 |
| Potassium Chlorate | 24.5 +/− 1.5 |
| Magnesium Carbonate | 17.0 +/− 2.0 |
| Sucrose | 16.5 +/− 1.0* |

*From about 12 to 100% of the sucrose is polymerized to form a binder.

EXAMPLES 1–9

EXAMPLE 1

Preparation of Binder

P-toluene sulfonic acid was dissolved in water and mixed together with industrial grade sugar in a batch reactor under vacuum at 400 mmHg and under continuous agitation, typically moderate agitation. The sugar, water, and the p-toluene sulfonic acid were added in quantities to provide a mass ratio of 1:0.005:0.1. The reaction was carried out at 90° C. and maintained at this temperature for the entire period of polymerization, which lasted for about two hours.

Water was stripped from the reaction by vacuum. The reaction was conducted in a liquid bath at the specified temperature. Removing the heat, agitation, and vacuum sources stopped the reaction and the binder material was obtained. The thus obtained binder was dissolved in water in quantities such that the mass ratio of the binder to water was 1:2 to thereby obtain a binder suitable for spraying a dry mixture of a smoke generating composition.

EXAMPLE 2

Preparation of Binder

P-toluene sulfonic acid was dissolved in water and mixed together with industrial grade sugar in a batch reactor under vacuum at 400 mmHg under continuous agitation. The sugar, water, and the p-toluene sulfonic acid were added in quantities with a mass ratio of 1:0.005:0.1. The reaction was carried out at 80° C. and maintained at this temperature for the period or polymerization, which extended for about two and half-hours.

Water was stripped from the reaction by the vacuum. The reaction was conducted in a liquid bath at a specified temperature. Removing the heat, agitation, and vacuum sources stopped the reaction and the binder material was obtained. The obtained binder was dissolved in water in quantities such that the mass ratio of the binder to water was 1:2 to thereby obtain a binder solution for spraying a dry mixture of a smoke generating composition.

EXAMPLE 3

Preparation of Binder

P-toluene sulfonic acid was dissolved in water and mixed together with industrial grade sugar in a batch reactor under vacuum at 400 mmHg under continuous agitation. The sugar, water and the p-toluene sulfonic acid were added in quantities to provide a mass ratio of 1:0.005:0.05. The reaction was carried out at 90° C. and maintained at this temperature for the period of polymerization, which extended for about 4 hours.

Water was stripped from the reaction by vacuum. The reaction was conducted in a liquid bath at the specified temperature. Removing the heat, agitation and vacuum sources stopped the reaction and the binder material was obtained. The obtained binder was dissolved in water in quantities such that the mass ratio of the binder to water was 1:2 to thereby obtain a binder solution suitable for spraying a dry mixture of a smoke generating composition.

EXAMPLE 4

Preparation of Binder

P-toluene sulfonic acid is dissolved in water and mixed together with industrial grade sugar in a batch reactor under vacuum at 400 mmHg under continuous agitation. The sugar, water, and the p-toluene sulfonic acid were added in quantities to provide a mass ratio of 1:0.003:0.1. The reaction was carried out at 90° C. and maintained at this temperature for the period of polymerization, which extended for about 1½ hours.

Water was stripped from the reaction by vacuum. The reaction was conducted in a liquid bath at the specified temperature. Removing the heat, agitation and vacuum sources stopped the reaction and the binder material was obtained. The obtained binder was dissolved in water in quantities such that the mass ratio of the binder to water was 1:2 to thereby obtain a binder solution suitable for spraying a dry mixture of a smoke generating composition.

EXAMPLE 5

Preparation of Binder

P-toluene sulfonic acid is dissolved in water and mixed together with industrial grade sugar in a batch reactor under vacuum at 400 mmHg under continuous agitation. The sugar, water, and the p-toluene sulfonic acid were added in quantities to provide a mass ratio of 1:0.0075:0.1. The reaction was carried out at 90° C. and maintained at this temperature for the period of polymerization, which extended for about 1½ hours.

Water was stripped from the reaction by vacuum. The reaction was conducted in a liquid bath at the specified temperature. Removing the heat, agitation and vacuum sources stopped the reaction and the binder material was obtained. The obtained binder was dissolved in water in quantities such that the mass ratio of the binder to water was 1:2 to thereby obtain a binder solution suitable for spraying a dry mixture of a smoke generating composition.

EXAMPLE 6

Preparation of Yellow Smoke Generating Composition

An approximately 30 lb. batch of a white generating smoke composition was prepared by combining 11.6 lbs. of terephthalic acid with 5.35 lbs. of pentaerythritol to form a mixture. The mixture was then combined with 1.35 lbs of magnesium carbonate, 0.6 lbs. of stearic acid, 6.9 lbs. of potassium chlorate and 3.15 lbs. of sucrose and tumbled in a fluidized bed until a homogenous mixture was obtained.

The resulting mixture was then sprayed with 1.05 lbs. of polymerized sucrose as a binder prepared in accordance with Example 1 in a fluidized bed to produce granules of a white smoke generating composition.

EXAMPLE 7

Preparation of Yellow Smoke Generating Composition

An approximately 30 lb. batch of a yellow generating smoke composition was prepared by combining 12.5 lbs. of a dye (solvent yellow 33) with 6.15 lbs. of magnesium carbonate, 6.75 lbs. of potassium chlorate and 3.45 lbs. of sucrose and tumbling the components in a fluidized bed until a homogenous mixture was obtained.

The resulting mixture was then sprayed with 1.15 lbs. of polymerized sucrose as a binder prepared in accordance with Example 1 in a fluidized bed to produce granules of a yellow smoke generating composition.

EXAMPLE 8

Preparation of Green Smoke Generating Composition

An approximately 30 lb. batch of a green generating smoke composition was prepared by combining 3.75 lbs. of a dye (solvent yellow 33), 8.85 lbs. of another dye (solvent green 3) with 5.1 lbs. of magnesium carbonate, 7.35 lbs. of potassium chlorate and 3.70 lbs. of sucrose and tumbling the components in a fluidized bed until a homogenous mixture was obtained.

The resulting mixture was then sprayed with 1.25 lbs. of polymerized sucrose as a binder prepared in accordance with Example 1 in a fluidized bed to produce granules of a green smoke generating composition.

EXAMPLE 9

Samples of a smoke generating composition described in Example 6 were tested for tensile strength in the following manner. The samples were compressed into the form of an annular slug and then tested with an inston machine to measure tensile strength. The tensile strength of the samples of the present invention was from about 88 to 120 pounds force (lbf).

A similar smoke generating composition using polyvinyl alcohol as a binder instead of polymerized sucrose was tested in the same manner as described above. The tensile strength of the comparative samples was determined to be from about 90 to 107 pounds force (lbf).

The results indicate that use of polymerized sucrose as a binder results in a smoke generating composition having at least as good tensile strength as similar smoke generating compositions using polyvinyl alcohol as a binder.

EXAMPLE 10

Grenades made from smoke generating compositions of the present invention produced in accordance with Example 6 were subjected to a burn test by burning the samples at −25° C., ambient temperature, and at 120° C. for 12 hours while recording 1.6 the burn time. The results are shown in Table 4.

TABLE 4

| Sample | −25° C. Sec. | Ambient Sec. | 120° C. Sec. |
|---|---|---|---|
| Sample 1 | 54 | 42 | 42 |
| Sample 2 | 56 | 43 | 42 |
| Sample 3 | 63 | 43 | 43 |
| Sample 4 | 52 | 41 | 43 |
| Sample 5 | 46 | 47 | 41 |

As shown in Table 4, the burn times of the samples of the present invention at −25° C. are not dramatically different than the burn times at ambient temperature and at 120° C. As a result the grenade can provide relatively uniform smoke quality over a wide temperature range and can therefore be effectively employed in cold, ambient and hot locations.

Comparative samples of a smoke generating composition produced in accordance with Example 6, except that polymerized sucrose was replaced with polyvinyl alcohol as a binder, were subjected to a burn test by burning the samples at −25° C., ambient temperature, and 120° C. for 12 hours while recording the burn time.

The results are shown in Table 5.

TABLE 5

| Comparative Sample | −25° C. Sec. | Ambient Sec. | 120° C. Sec. |
|---|---|---|---|
| Comparative Sample 1 | 74 | 60 | 40 |
| Comparative Sample 2 | 71 | 61 | 46 |
| Comparative Sample 3 | 76 | 53 | 47 |
| Comparative Sample 4 | 83 | 50 | 48 |
| Comparative Sample 5 | 75 | 57 | 47 |

As shown in Table 5, the burn times at −25° C. are dramatically longer than the burn times at ambient temperature and 120° C. which results in a lower quality smoke when employed in a relatively cold environment. In addition, the longer burn times for the comparative compositions are generally indicative of a lower quality smoke.

EXAMPLE 11

Measurement of Ash Content

Smoke generating grenades prepared in accordance with Example 6 and similar smoke generating grenades prepared with polyvinyl alcohol as a binder were tested to measure the residual ash content as a means of measuring the efficiency of the smoke generating compositions in producing smoke as shown in Tables 6 and 7, respectively.

As shown by a comparison of the results in Tables 6 and 7, a greater amount of the smoke generating materials were consumed (i.e. less ash content) in the smoke generating materials of the present invention than with the comparative compositions. Accordingly, more smoke is generated per unit weight of the smoke generating composition of the present invention.

TABLE 6

Compositions Of The Present Invention

| Initial Weight in grams for White Smoke Grenades | Final Weight in grams for Fired White Smoke Grenades | Weight of material in grams used for Generating White Smoke |
|---|---|---|
| 479.28 | 232.77 | 246.51 |
| 481.60 | 234.00 | 247.60 |
| 481.34 | 228.11 | 253.23 |
| 480.80 | 219.92 | 260.88 |
| 484.35 | 230.91 | 253.44 |
| 481.41 | 225.90 | 255.51 |

TABLE 7

Comparative Compositions

| Initial Weight in grams for White Smoke Grenades | Final Weight in grams for Fired White Smoke Grenades | Weight of material in grams used for Generating White Smoke |
|---|---|---|
| 480.28 | 250.70 | 229.58 |
| 471.79 | 245.58 | 226.21 |
| 484.87 | 247.09 | 237.78 |
| 479.69 | 254.17 | 225.52 |
| 480.27 | 244.81 | 235.46 |
| 484.17 | 250.11 | 234.06 |

What is claimed is:

1. A smoke generating composition, comprising:

(a) a smoke generating material and (b) a binder comprising poymerized sucrose, wherein said polymerized sucrose is prepared by polymerizing sucrose in the presence of acid catalyst and water.

2. The smoke generating composition of claim 1, wherein said polymerized sucrose is made by a process comprising dissolving p-toluene sulfonic acid in water and mixing with sugar in a batch reactor under vacuum and continuous agitation.

3. The smoke generating composition of claim 2, wherein said process is carried out under vacuum of about 400 mmHg.

4. The smoke generating composition of claim 2, wherein said process is carried out at about 90° C.

5. The smoke generating composition of claim 2, wherein said process is carried out at about 80° C.

6. The smoke generating composition of claim 2, wherein said sugar, water and p-toluene sulfonic acid are added to said reactor in quantities to provide a mass ratio of about 1.0:0.005:0.1, respectively.

7. The smoke generating composition of claim 2, wherein said sugar, water and p-toluene sulfonic acid are added to said reactor in quantities to provide a mass ratio of about 1.0:0.003:0.1, respectively.

8. The smoke generating composition of claim 2, wherein said process is carried for a period of polymerization of about 1 to about 4 hours.

9. The smoke generating composition of claim 1, wherein said smoke generating material comprises a submixture of terephthalic acid alone or in combination with pentaerythritol, and wherein said sub-mixture is further mixed with magnesium carbonate, potassium chlorate, and sucrose, wherein said sucrose is optionally polymerized.

10. The smoke generating composition of claim 9, wherein said smoke generating material further includes stearic acid.

11. The smoke generating material of claim 9, wherein said sub-mixture comprises 70–100 weight percent terephthalic acid and 0–30 weight percent pentaeythritol.

12. The smoke generating composition of claim 9, wherein said smoke generating material comprises about 56 weight percent sub-mixture of terephthalic acid and pentaerythritol, about 5 weight percent magnesium carbonate, about 2 weight percent stearic acid, about 23 weight potassium chlorate, and about 14 weight percent sucrose, and wherein of said about 14 weight percent sucrose from about 12 to 100 weight percent is polymerized to form said binder.

13. The smoke generating composition of claim 1, wherein said smoke generating material comprises a mixture of solvent yellow 33 dye, potassium chlorate, magnesium carbonate, and sucrose, wherein said sucrose is optionally polymerized.

14. The smoke generating composition of claim 13, wherein said smoke generating composition comprises about 42 weight percent solvent yellow 33 dye, about 23 weight percent potassium chlorate, about 20 weight percent magnesium carbonate, and about 15 weight percent sucrose, and wherein of said about 15 weight percent sucrose about 12 to 100 percent is polymerized to form said binder.

15. The smoke generating composition of claim 1, wherein said smoke generating material comprises a mixture of solvent yellow 33 dye, solvent green 3 dye, potassium chlorate, magnesium carbonate, and sucrose, wherein said sucrose is optionally polymerized.

16. The smoke generating composition of claim 15, wherein said smoke generating composition comprises about 12.5 weight percent solvent yellow 33 dye, about 29.5 weight percent solvent green 3 dye, about 24.5 weight percent potassium chlorate, about 17 weight percent magnesium carbonate, and about 16.5 weight percent sucrose, and wherein of said about 16.5 weight percent sucrose about 12 to 100 percent is polymerized to form said binder.

17. A method of producing a smoke generating composition, said method comprising treating a smoke generating material with a binder comprising polymerized sucrose, said polymerized sucrose being provided in an amount to effectively act as a binder for said smoke composition, wherein said polymerized sucrose is prepared by polymerizing sucrose in the presence of acid catalyst and water.

18. The method of claim 17, wherein said polymerization is carried out at a temperature of from about 60 to 120° C. and at a vacuum of from about 200 to 700 mmHg.

19. The method of claim 17, wherein said sucrose, said acid catalyst, and said water are present to provide a mass ratio of from about 1.0:0.001:0.04 to about 1.0:0.01:0.15, respectively.

20. The method of claim 19, wherein said mass ratio of sucrose to acid catalyst to water is about 1.0:0.005:0.1, respectively.

21. The method of claim 17, wherein said acid catalyst is selected from the group consisting of p-toluene sulfonic acid and sulfuric acid.

22. The method of claim 17, wherein said smoke generating material comprises a sub-mixture of terephthalic acid alone or in combination with pentaerythritol, and wherein said sub-mixture is farther mixed with magnesium carbonate, potassium chlorate, and sucrose, wherein said sucrose is optionally polymerized.

23. The method of claim 22, wherein said smoke generating material further includes stearic acid.

24. The method of claim 22, wherein said sub-mixture comprises 70–100 weight percent terephthalic acid and 0–30 weight percent pentaerythritol.

25. The method of claim 22, wherein said smoke generating material comprises about 56 weight percent sub-mixture of terephthalic acid and pentaerythritol, about 5 weight percent magnesium carbonate, about 2 weight percent stearic acid, about 23 weight percent potassium chlorate, and about 14 weight percent sucrose, and wherein of said about 14 weight percent sucrose from about 12 to 100 weight percent is polymerized to form said binder.

26. The method of claim 17, wherein said smoke generating material comprises a mixture of solvent yellow 33 dye, potassium chlorate, magnesium carbonate, and sucrose, wherein said sucrose is optionally polymerized.

27. The method of claim 26, wherein said smoke generating composition comprises about 42 weight percent solvent yellow 33 dye, about 23 weight percent potassium chlorate, about 20 weight percent magnesium carbonate, and about 15 weight percent sucrose, and wherein of said about 15 weight percent sucrose about 12 to 100 percent is polymerized to form said binder.

28. The method of claim 17, wherein said smoke generating material comprises a mixture of solvent yellow 33 dye, solvent green 3 dye, potassium chlorate, magnesium carbonate, and sucrose, wherein said sucrose is optionally polymerized.

29. The method of claim 28, wherein said smoke generating composition comprises about 12.5 weight percent solvent yellow 33 dye, about 29,5 weight percent solvent green 3 dye, about 24.5 weight percent potassium chlorate, about 17 weight percent magnesium carbonate, and about 16.5 weight percent sucrose, and wherein of said about 16.5 weight percent sucrose about 12 to 100 percent is polymerized to form said binder.

* * * * *

UNITED STATES PATENT AND TRADEMARK OFFICE

CERTIFICATE OF CORRECTION

PATENT NO. : 6,558,487 B1
DATED : May 6, 2003
INVENTOR(S) : Raef M. Tadros

It is certified that error appears in the above-identified patent and that said Letters Patent is hereby corrected as shown below:

Column 6,
Line 65, change "-25° C" to -- -25° F --
Line 65, change "120° C" to -- 120° F --

Column 7,
Line 3, table 4, change "-25° C" to -- -25° F --
Line 4, table 4 change "120° C" to -- 120° F --
Line 14, change "-25° C" to -- -25° F --
Line 15, change "120° C" to -- 120° F --
Line 24, change "-25° C" to -- -25° F --
Line 24, change "120° C" to -- 120° F --
Line 31, table 5, change "-25° C" to -- -25° F --
Line 31, table 5, change "120° C" to -- 120° F --
Line 40, change "-25° C" to -- -25° F --
Line 42, change "120° C" to -- 120° F --

Signed and Sealed this

Twenty-eighth Day of June, 2005

JON W. DUDAS
*Director of the United States Patent and Trademark Office*